US009291027B2

(12) United States Patent
Kristensen et al.

(10) Patent No.: US 9,291,027 B2
(45) Date of Patent: Mar. 22, 2016

(54) PACKER AND PACKER OUTER LAYER

(71) Applicant: Schlumberger Technology Corporation, Sugar Land, TX (US)

(72) Inventors: Morten Kristensen, Auning (DK); Cosan Ayan, Istanbul (TR); Pierre-Yves Corre, Eu (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 417 days.

(21) Appl. No.: 13/750,923

(22) Filed: Jan. 25, 2013

(65) Prior Publication Data

US 2014/0209302 A1 Jul. 31, 2014

(51) Int. Cl.
*E21B 33/12* (2006.01)
*E21B 49/08* (2006.01)

(52) U.S. Cl.
CPC ..... *E21B 33/12* (2013.01); *E21B 33/1208* (2013.01); *E21B 49/08* (2013.01)

(58) Field of Classification Search
None
See application file for complete search history.

(56) References Cited

U.S. PATENT DOCUMENTS

| | | | |
|---|---|---|---|
| 2,581,070 | A | 1/1952 | Blood |
| 2,693,342 | A | 11/1954 | Lynes |
| 2,843,208 | A | 7/1958 | Blood |
| 3,104,712 | A | 9/1963 | Whitten |
| 3,859,851 | A | 1/1975 | Urbanosky |
| 3,899,631 | A | 8/1975 | Clark |
| 4,127,169 | A | 11/1978 | Tubin et al. |
| 4,353,249 | A | 10/1982 | Lagus et al. |
| 4,392,376 | A | 7/1983 | Lagus et al. |
| 4,485,868 | A | 12/1984 | Sresty et al. |
| 4,860,581 | A | 8/1989 | Zimmerman et al. |
| 4,936,139 | A | 6/1990 | Zimmerman et al. |
| 5,056,595 | A | 10/1991 | Desbrandes |
| 5,233,866 | A | 8/1993 | Desbrandes |
| 6,065,544 | A | 5/2000 | Holbert |
| 6,208,316 | B1 | 3/2001 | Cahill |
| 6,269,882 | B1 | 8/2001 | Wellington et al. |
| 6,301,959 | B1 | 10/2001 | Hrametz et al. |
| 6,699,019 | B2 | 3/2004 | Myers et al. |

(Continued)

FOREIGN PATENT DOCUMENTS

| | | | |
|---|---|---|---|
| GB | 2404403 | A | 2/2005 |
| GB | 2418938 | A | 4/2006 |

(Continued)

OTHER PUBLICATIONS

International Search Report and Written Opinion issued in PCT/US2014/012871 on May 8, 2014; 15 pages.

(Continued)

*Primary Examiner* — Jennifer H Gay
*Assistant Examiner* — Caroline Butcher
(74) *Attorney, Agent, or Firm* — Kenneth L. Kincaid

(57) ABSTRACT

A packer is disclosed comprising a body with a first end and a second end, wherein the first end and the second end are configured to establish a connection with downhole equipment and wherein at least one of the first end and the second end is configured to establish a fluid flow between the downhole equipment, at least one guard drain, at least one sample drain, at least one guard drain flow line, at least one sample drain flow line configured to transport fluid flow from and to the at least one sample drain and one of the first end and the second end of the body, two swivel connections and a sealing element.

13 Claims, 4 Drawing Sheets

(56) References Cited

U.S. PATENT DOCUMENTS

| | | | | |
|---|---|---|---|---|
| 6,755,246 | B2 | 6/2004 | Chen et al. | |
| 6,766,854 | B2 | 7/2004 | Ciglenec et al. | |
| 7,347,262 | B2 | 3/2008 | Tarvin et al. | |
| 7,380,599 | B2 | 6/2008 | Fields et al. | |
| 7,878,243 | B2 | 2/2011 | Goodwin et al. | |
| 8,016,038 | B2 | 9/2011 | Goodwin et al. | |
| 8,162,052 | B2 | 4/2012 | Goodwin et al. | |
| 8,490,694 | B2 * | 7/2013 | Corre et al. | 166/264 |
| 2003/0034777 | A1 | 2/2003 | Chen et al. | |
| 2003/0217845 | A1 | 11/2003 | Sherwood et al. | |
| 2004/0093937 | A1 | 5/2004 | Hashem | |
| 2004/0104341 | A1 | 6/2004 | Betancourt et al. | |
| 2005/0155760 | A1 | 7/2005 | Hill et al. | |
| 2005/0279499 | A1 | 12/2005 | Tarvin et al. | |
| 2006/0042793 | A1 | 3/2006 | Del Campo et al. | |
| 2006/0137873 | A1 | 6/2006 | Caudwell et al. | |
| 2006/0155472 | A1 | 7/2006 | Venkataramanan et al. | |
| 2006/0162935 | A1 | 7/2006 | MacDougall | |
| 2006/0248949 | A1 | 11/2006 | Gregory et al. | |
| 2007/0215348 | A1 | 9/2007 | Corre et al. | |
| 2008/0066904 | A1 | 3/2008 | Van Hal et al. | |
| 2008/0078581 | A1 | 4/2008 | Goodwin et al. | |
| 2008/0115575 | A1 | 5/2008 | Meek et al. | |
| 2008/0156486 | A1 | 7/2008 | Ciglenec et al. | |
| 2009/0008079 | A1 | 1/2009 | Zazovsky et al. | |
| 2009/0091320 | A1 | 4/2009 | Flaum et al. | |
| 2009/0159278 | A1 | 6/2009 | Corre et al. | |
| 2010/0071898 | A1 | 3/2010 | Corre et al. | |
| 2010/0319912 | A1 | 12/2010 | Pop et al. | |
| 2011/0277999 | A1 | 11/2011 | Corre et al. | |

FOREIGN PATENT DOCUMENTS

| | | | |
|---|---|---|---|
| GB | 2420135 | A | 5/2006 |
| GB | 2431673 | A | 5/2007 |
| GB | 2445846 | A | 7/2008 |
| WO | 03016826 | A2 | 2/2003 |
| WO | 2007048991 | A1 | 5/2007 |
| WO | 2008036520 | A1 | 3/2008 |
| WO | 2008150825 | A1 | 12/2008 |
| WO | 2010032152 | A1 | 3/2010 |
| WO | WO2012088058 | A2 * | 6/2012 |

OTHER PUBLICATIONS

Burgess, K., Fields, T., Harrigan, E., Golich, G. M., MacDougall, T., Reeves, R., Smith, S., Thornsberry, K., Ritchie, B., Rivero, R., and Siegfried, R., "Formation Testing and Sampling Through Casing", Oilfield Review, Schlumberger, Spring 2002: pp. 46-57.

International Search Report and Written Opinion of PCT Application No. PCT/US2009/032585 dated May 25, 2009: pp. 1-9.

International Search Report and Written Opinion of PCT Application No. PCT/US2009/031635 dated May 25, 2010: pp. 1-8.

International Preliminary Report on Patentability and Written Opinion of PCT Application No. PCT/US2009/031635 dated Jul. 27, 2010: pp. 1-6.

International Preliminary Report on Patentability and Written Opinion of PCT Application No. PCT/US2009/032585 dated Aug. 10, 2010: pp. 1-7.

CIPO Exam Report of Canadian Application No. 2713396 dated Jun. 13, 2012: pp. 1-9.

CIPO Exam Report of Canadian Application No. 2714501 dated Jun. 15, 2012: pp. 1-5.

* cited by examiner

PACKER AND PACKER OUTER LAYER

CROSS REFERENCE TO RELATED APPLICATIONS

None.

FIELD OF THE INVENTION

Aspects of the disclosure relate to packers. More specifically, aspects of the disclosure relate to downhole packers and packer outer layers used in the oil field services market.

BACKGROUND INFORMATION

Use of packers in downhole oilfield service markets is a significantly important aspect of today's downhole drilling operations. These packers are used to isolate various sections of the drilled downhole wells. By isolating these various sections, operators may perform sampling functions. Packer systems come in various forms and may include systems such as single, dual and quad packers. Single packers are currently being developed to allow operators the ability to isolate selected sections of the downhole environment based upon various formation features.

There are many disadvantages in the use of dual and quad packer designs. Among these disadvantages are excessive weight for the dual and quad packer designs. Additionally, some systems are very long heavy and expensive and difficult to deploy on wireline tools. There is a need to provide a system that provides a large surface area combined with a superior sealing efficiency as well as a resistance to plugging from foreign contaminants entering the packer.

SUMMARY

In one embodiment described, a packer is provided comprising a body with a first end and a second end, wherein the first end and the second end are configured to establish a connection with downhole equipment and wherein at least one of the first end and the second end is configured to establish a fluid flow between the downhole equipment and the packer, and wherein at least a portion of the body is configured to expand from a first unexpanded configuration to a second expanded configuration; at least one guard drain with a circular shape through the body; at least one sample drain with an oval shape through the body, the at least one sample drain located in an axial line with the at least one guard drain with the circular shape; at least one guard drain flow line configured to transport fluid flow from and to the at least one guard drain; a swivel connection connected to the at least one guard drain flow line and one of the first end and the second end, the swivel connection configured to transport fluid from the at least one guard drain flow line to one of the first end and the second end; at least one sample drain flow line configured to transport fluid flow from and to the at least one sample drain; a second swivel connection connected to the at least one sample drain flow line and one of the first end and the second end, the second swivel connection configured to transport fluid to and from the at least one sample drain flow line to one of the first end and the second end; and a sealing element placed around a periphery of the body incorporating the at least one guard drain and the at least one sample drain, the sealing element configured to create a seal between the sealing element and a downhole geological formation.

In another embodiment a packer is described comprising a body with a first end and a second end, wherein the first end and the second end are configured to establish a connection with downhole equipment and wherein at least one of the first end and the second end is configured to establish a fluid flow between the downhole equipment, at least two guard drains, each of the guard drains with one half circular shape, at least one sample drain with a rectangular shape, the at least one sample drain located in an axial line with the at least two guard drains with the one half circular shape, at least one guard drain flow line configured to transport fluid flow from and to the at least two guard drains, a swivel connection between the at least one guard drain flow line and one of the first end and the second end, the swivel connection configured to transport fluid to and from the at least one guard drain flow line to one of the first end and the second end, at least one sample drain flow line configured to transport fluid flow from and to the at least one sample drain, a second swivel connection between the at least one sample drain flow line and one of the first end and the second end, the second swivel connection configured to transport fluid and a sealing element placed around a periphery of the body incorporating the at least two guard drains and the at least one sample drain with a rectangular shape, the sealing element configured to create a seal between the sealing element and a downhole geological formation.

In another embodiment, a packer is disclosed comprising a body with a first end and a second end, wherein the first end and the second end are configured to establish a connection with downhole equipment and wherein at least one of the first end and the second end is configured to establish a fluid flow between the downhole equipment and the packer; at least two guard drains, each of the guard drains with one half circular shape; at least one sample drain with a rectangular shape, the at least one sample drain located in an axial line with the at least two guard drains with the one half circular shape; at least one guard drain flow line configured to transport fluid flow from and to the at least two guard drains; at least one swivel connection between the at least one guard drain flow line and one of the first end and the second end, the at least one swivel connection configured to transport fluid to and from the at least one guard drain flow line to one of the first end and the second end; at least one sample drain flow line configured to transport fluid flow from and to the at least one sample drain; at least one second swivel connection between the at least one sample drain flow line and one of the first end and the second end, the at least one second swivel connection configured to transport fluid; and a sealing element placed around a periphery of the body incorporating the at least two guard drains and the at least one sample drain with a rectangular shape, the sealing element configured to create a seal between the sealing element and a downhole geological formation.

In another embodiment, a method of sampling is disclosed, comprising expanding a packer from a first contracted state to a second expanded state, wherein the second expanded state occurs downhole and to establish an environment between the packer and a downhole formation when in the second expanded state, establishing a guard drain flow in the packer through a guard drain, establishing a sample drain flow in the packer through a sample drain, wherein the sample drain flow and the guard drain flow are in an axial relationship and sampling at least a portion of the sample drain flow.

DETAILED DESCRIPTION

In the following description, numerous details are set forth to provide an understanding of aspects of the present disclosure. It will be understood by those of ordinary skill in the art that the aspects described may be practiced without these details and that numerous variations or modifications from the described embodiments may be possible.

Figure 5:
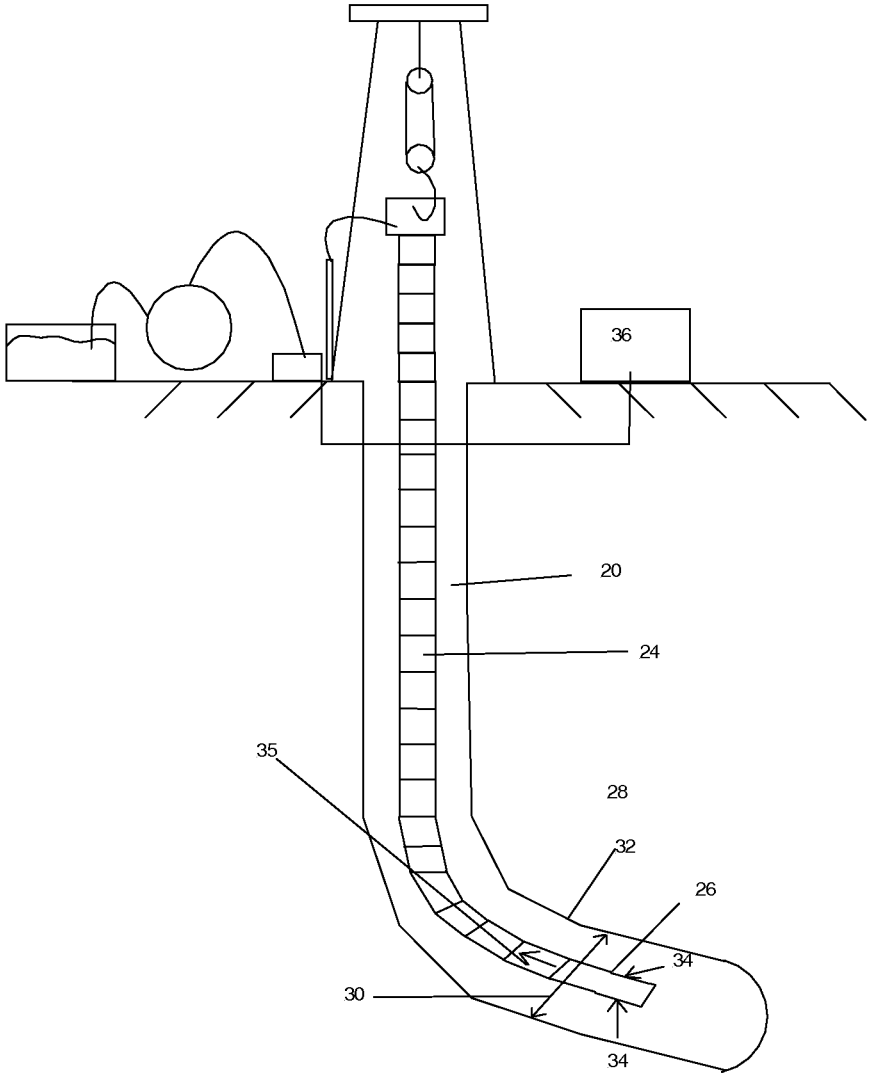
FIG. 5 is a side view of an embodiment of a well system as deployed in a wellbore.

Referring generally to FIG. 5, one embodiment of a well system 20 is illustrated as displayed in a wellbore 22. The well system 20 comprises a conveyance 24 employed to deliver at least one packer 26 downhole. In many applications, packer 26 is deployed by conveyance 24 such as a tubular string, but conveyance 24 may have other forms, such as wireline for other applications. In the embodiment illustrated, packer 26 is an expandable packer used to collect formation fluid samples from a surrounding formation 28. The packer 26 is selectively expanded in a radially outward direction to seal across expansion zone 30 with a wellbore wall 32, such as a surrounding casing or opening wellbore wall. When packer 26 is expanded to seal against wellbore wall 32, formation fluids can flow into packer 26, as indicated by arrows 34. The formation fluids are then directed to a flow line, as represented by arrow 35, and produced to a collection receptacle within a sampling tool or other collection location, such as a location at a well site surface 36. The formation fluids may enter the packer 26 through ports, either sample or guard types (described later) for sampling or prevention of contamination purposes. The entrance of the fluids into the packer 26 may occur when the packer 26 is an expanded state. Fluids may enter through activation of a pump associated with the packer 26 or the difference of pressure from the formation into the packer 26.

The packer 26 may be expanded across the expansion zone 30 along the formation 28 to facilitate sample collection of the subject fluids. The fluid sample is collected and then directed along flow lines 35, for example, along flow tubes, having sufficient inner diameter to allow inflow of sample material from sample collection operations in a variety of environments. The sample materials may be directed along the conveyance or the materials may be stored along the conveyance, such as in a sampling tool. For materials stored in the packer 26, for example, the materials may be stored in a sample bottle or numerous sample bottles. These sample bottles may be designed to retain pressure and temperature to the greatest extent possible, for later testing. The sample materials may include formation fluids which may include solid materials. Formation fluid samples can be collected through one or more drains, described later. Separate drains may be disposed at distinct locations around the packer 26 to establish collection intervals or zones that enable focused sampling at a plurality of collecting regions or intervals along the expansion zone 30. Separate flow lines can be connected to different drains to enable the collection of unique formation fluid samples from the different regions or intervals. These separate flow lines may be maintained in discrete flowpaths so that flows from individual areas in the packer 26 may be sampled. In an alternative configuration, the separate flow lines may be combined for sampling.

Figure 1:
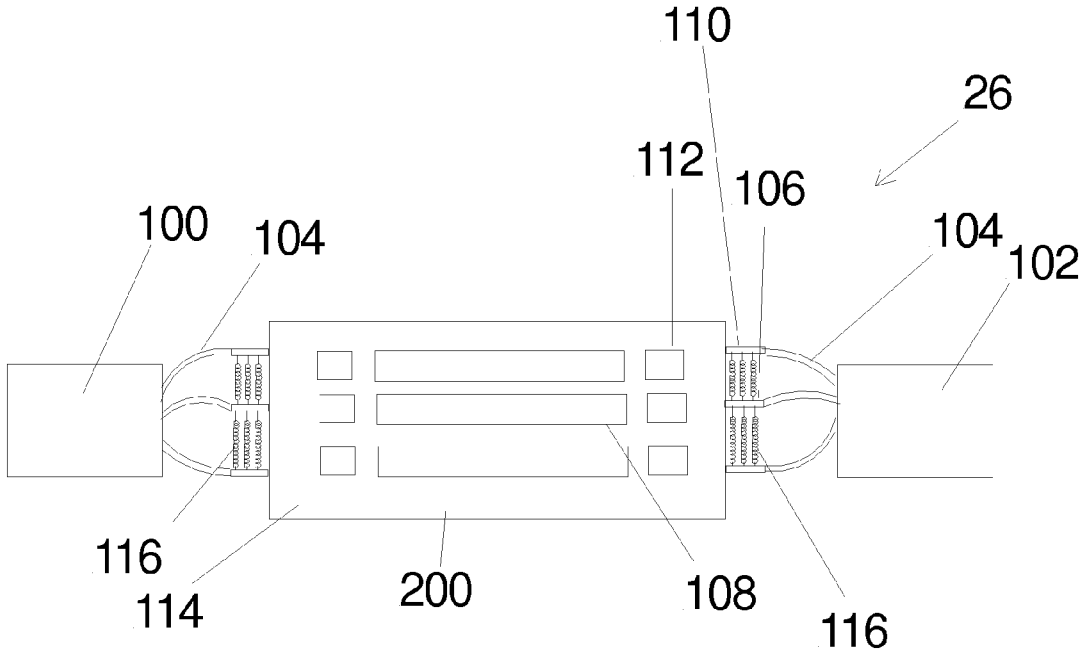
FIG. 1 is a side perspective view of a single packer for use in downhole environments, in conformance with an example embodiment described.

Referring to FIG. 1, a perspective view of a packer 26 is illustrated. In the illustrated embodiment, a first end 100 and a second end 102 are adapted for connection to other downhole tools that may be found, for example, in a wireline tool assembly system. The first end 100 and the second end 102 are configured of a rugged material, such as metal, to allow for anticipated downhole pressures to be exerted while the packer 26 is in use in the downhole environment. A series of swivel connections 104 are provided from both the first end 100 and the second end 102 such that when inflation of the packer 26 is accomplished, and the outer radial distance of the packer grows through, for example from injection of fluid into the packer 26, the swivel connection 104 allows for fluid to be transported through the swivel connections 104 from either the first end 100 or the second end 102 to the respective port that is connected to the individual flow lines. As illustrated, a sample flow line 106 is connected to a sample port 108 and a guard flow line 110 is connected to a guard port 112. Both the sample flow line 106 and the guard flow line 110 are supported on the body 114 such that when radial increase of the packer dimensions from injection of fluid are accomplished, the flow lines 106, 110 are not stressed to a large degree from differential movement along the longitudinal axis of the respective flow lines 106, 110. Springs 116, as illustrated connecting the respective flow lines 106, 110, may be positioned along the length of the flow lines 106, 110 to provide for a more uniform movement during packer expansion. At least a portion of the body 114 is an expandable bladder 200 that is configured to expand from a first unexpanded state to a second expanded state. The expandable bladder 200 is expanded by fluid delivered through action, for example, of an inner mandrel.

Figure 2:
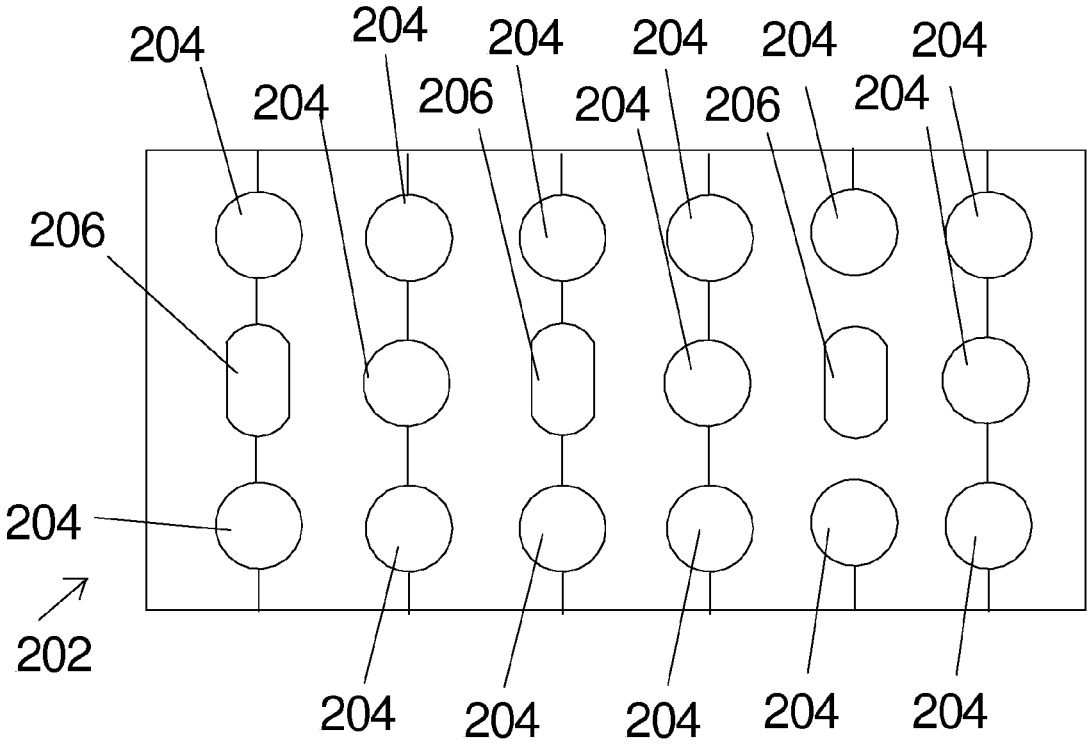
FIG. 2 is a top view of an expanded alternative outer cover layer of a packer.
Figure 3:
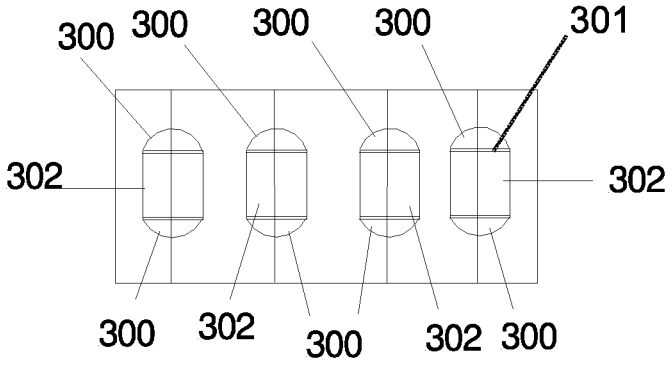
FIG. 3 is a top view of an expanded alternative outer cover layer of a packer with adjoined guard inlets and sample inlets.
Figure 4:
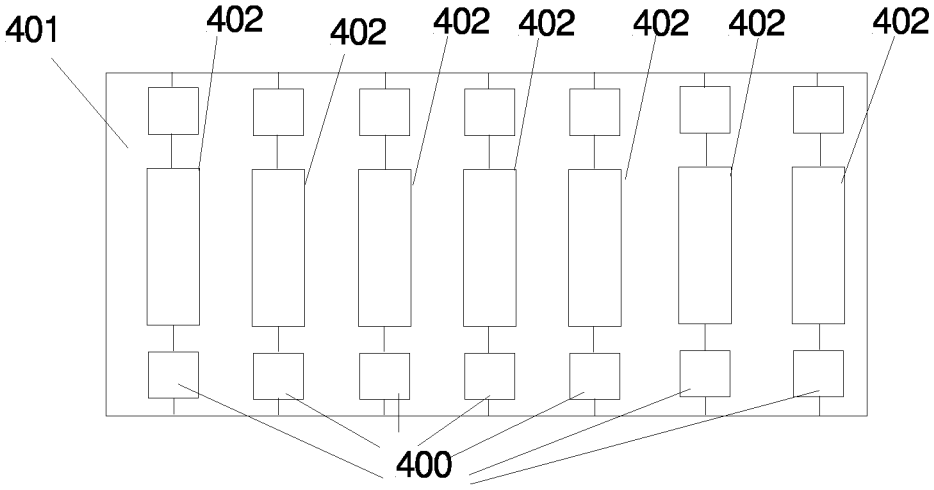
FIG. 4 is a top view of an expanded alternative outer cover layer of a packer with linear spaced guard and sample inlets with rectangular ports.

FIGS. 2-4 are oriented such that the left side of FIGS. 2-4 is the side which faces one end of the packer 26, such as the first end 100 or the second end 102, and the right side of FIGS. 2-4 is the side which faces the other end of the packer 26. Accordingly, left-to-right and right-to-left in FIGS. 2-4 are axial directions, and top-to-bottom and bottom-to-top in FIGS. 2-4 are radial directions.

Referring to FIG. 2, an expanded view of an alternative cover for the outer surface 202 of the packer 26 is illustrated. In the illustrated view, separate guard inlets 204 are provided separate from sample inlets 206. The guard inlets 204 are located in an axially linear orientation to the sample inlets 206 while others are shifted azimuthally relative to the sample inlets. In the illustrated embodiment, the guard inlets 204 are circular and the sample inlets 206 are oval. As can be appreciated from the view provided, a series of eight guard inlets 204 surround each sample inlet 206. Through this configuration, it has been discovered that the guard inlets 204 protect the sample inlets 206 from unwanted contamination and therefore the guard inlets 204 minimize contamination received through the sample inlets 206. As will be understood, pumping from the individual guard inlets 204 can occur prior to the pumping at each sample inlet 206. Pumping fluids from a formation 28 through the guard inlets 204 allows for loose materials and contamination from potential drilling fluid to be eliminated from any fluid that would be obtained through the sample inlet 206 as the guard inlets 204 would remove any such contaminants prior to accurate samples being obtained through the sample inlets 206. In this embodiment, the guard drains 204 are located around the sampling inlet 206 in order to speed up clean up in the case of high formation anisotropy which restricts vertical flow.

Referring to FIG. 3, a second concept with guard inlets and sample inlets is provided for the packer 26 wherein the inlets are provided in approximately the same drain location. A pad 301 is placed in between the guard 300 and sample 302 inlets to provide sealing between the sample and the guard zone. The pad 301 may be configured, for example, of rubber. One particular advantage of this embodiment is that a focused sampling may be accomplished as the guard inlets 300 are closely located to the sample inlets 302. In this embodiment, half circular guard inlets 300 are arranged along an axis that is similar or identical to the sample inlet 302 provided in the center of the port. Experience has found that the location of the guard inlet 300 close to the sample inlet 302 allows for superior removal of contaminants from areas near the sample inlets 302.

Referring to FIG. 4, a third concept of a cover for the packer 26 is illustrated with a surface 401 with inlet drains that are rectangular instead of being circular or oval. In the illustrated embodiment, sample inlets 402 are provided that range to be approximately twice the size in area of an individual guard inlet 400 thereby providing increased sampling inlet surface area for this embodiment. This embodiment provides for maximum sampling surface for a given width and length of each packer 26. In each of the embodiments described in FIGS. 2 to 4, sampling may start with the guard inlets 400 so that materials that may be loose or contaminated are removed from the virgin fluid stream desired to be sampled. Operation of the guard 400 and sample 402 inlets and streams, however, may occur at any time, with operators choosing either guard 400 or sample 402 inlets for fluid flow, or both types at the same time. Additionally, operations of the guard and sample inlets may be done at intermittent periods, therefore guard inlets 400 may be active at first, followed by a sample inlet 402 activation and contemporaneous cessation of guard inlets 400.

In each embodiment illustrated, the packer 26 is covered by a layer of material that is provided to prevent materials from entering the body of the packer 26. The foreign material exclusion provided by the layer of material allows the packer 26 to operate in contaminated zones with no impingement of materials on internal components. Holes are placed in the cover layer of material to allow for the inlets of each of the guard and sample zones to recover fluid materials from the formation. The layer of material used may be made of any flexible material, such as rubber, to allow for repeated expansion and contraction of the packer. The drains may be embedded radially into a sealing element or seal layer which surrounds the outer structural layer. The sealing layer may be cylindrical and formed of an elastomeric material selected for hydrocarbon based applications, such as nitrile rubber (NBR), hydrogenated nitrile butadiene rubber (HHBR) and fluorocarbon rubber (FKM).

In embodiments disclosed, a heater may be placed within the body of the packer 26 such that heat produced by the heater can change the viscosity of fluids located within the proximity of the packer 26. As a non-limiting example, high viscosity fluids that have a difficulty flowing under certain conditions can be exposed to the heat, thereby causing the fluids to flow. The heating elements may be powered via an electric power line routed to the packer 26 and the heat may be generated by heating elements over intervals of time, such as predetermined periods of time, to sufficiently lower the viscosity of the desired material.

At least one temperature sensor may also be included in the packer 26 proximate the heating elements previously described. The temperature sensor may be used to monitor temperatures to enable better control over the sampling and also guard against creating excessive heat along an external seal surface of the packer 26.

In the embodiments illustrated and described, the packer 26 is designed to withstand hydrostatic pressures and temperatures in a variety of wellbore environments and foundation types. These hydrostatic pressures may be in excess of 30000 pounds per square inch and 200 degrees Centigrade.

While embodiments have been described in detail above, those of ordinary skill in the art will readily appreciate that many modifications are possible without materially departing from the teachings of the aspects described. Such modifications are intended to be included within the scope of this disclosure as defined in the claims.

What is claimed is:

1. A packer, comprising:

a body with a first end and a second end, wherein the first end and the second end are configured to establish a connection with downhole equipment and wherein at least one of the first end and the second end is configured to establish a fluid flow between the downhole equipment and the packer, and wherein at least a portion of the body is configured to expand from a first unexpanded configuration to a second expanded configuration;

at least two guard drains with a circular shape through the body;

at least two sample drains with an oval shape through the body, at least one of the two sample drains located in an axial line with a first one of the two guard drains with the circular shape, wherein a second one of the two guard drains is circumferentially aligned with the at least two sample drains and disposed radially therebetween;

at least one guard drain flow line configured to transport fluid flow from and to the at least two guard drains;

a swivel connection connected to the at least one guard drain flow line and one of the first end and the second end, the swivel connection configured to transport fluid from the at least one guard drain flow line to one of the first end and the second end;

at least one sample drain flow line configured to transport fluid flow from and to the at least two sample drains;

a second swivel connection connected to the at least one sample drain flow line and one of the first end and the second end, the second swivel connection configured to transport fluid to and from the at least one sample drain flow line to one of the first end and the second end; and a sealing element placed around a periphery of the body incorporating the at least two guard drains and the at least two sample drains, the sealing element configured to create a seal between the sealing element and a downhole geological formation.

2. The packer according to claim 1, wherein the sealing element is made of rubber.

3. The packer according to claim 1, wherein the downhole equipment is a wireline tool.

4. The packer according to claim 1, further comprising:

a heater configured to heat formation fluid to change formation fluid viscosity.

5. The apparatus according to claim 1, wherein at least a portion of the body comprises an expandable bladder.

6. A packer, comprising:

a body with a first end and a second end, wherein the first end and the second end are configured to establish a connection with downhole equipment and wherein at least one of the first end and the second end is configured to establish a fluid flow between the downhole equipment and the packer;

at least two guard drains, each of the guard drains with one half circular shape;

at least one sample drain with a rectangular shape, the at least one sample drain located in an axial line with the at least two guard drains with the one half circular shape;

a pad disposed between and coupled to both the at least two guard drains and the at least one sample drain, wherein the pad is configured to provide sealing between the at least two guard drains and the at least one sample drain;

at least one guard drain flow line configured to transport fluid flow from and to the at least two guard drains;

at least one swivel connection between the at least one guard drain flow line and one of the first end and the second end, the at least one swivel connection configured to transport fluid to and from the at least one guard drain flow line to one of the first end and the second end;

at least one sample drain flow line configured to transport fluid flow from and to the at least one sample drain;

at least one second swivel connection between the at least one sample drain flow line and one of the first end and the second end, the at least one second swivel connection configured to transport fluid; and a sealing element placed around a periphery of the body incorporating the at least two guard drains and the at least one sample drain with a rectangular shape, the sealing element configured to create a seal between the sealing element and a downhole geological formation.

7. The packer according to claim 6, wherein the sealing element is made of rubber.

8. The packer according to claim 6, wherein the downhole equipment is a wireline tool.

9. A method of sampling, comprising:

expanding a packer from a first contracted state to a second expanded state, wherein the second expanded state occurs downhole to form an environment between the packer and a downhole formation when in the second expanded state;

establishing a guard drain flow in the packer through a guard drain;

establishing a sample drain flow in the packer through a sample drain, wherein the sample drain flow and the guard drain flow are in an axial relationship;

providing sealing between the guard drain and the sample drain using a pad disposed between and coupled to both the guard drain and the sample drain; and sampling at least a portion of the sample drain flow.

10. The method according to claim 9, wherein the guard drain flow is established through at least two guard drains.

11. The method according to claim 10, wherein the at least two guard drains are rectangular shaped.

12. The method according to claim 10, wherein the at least two guard drains are half-circle shaped.

13. The method according to claim 10, wherein the at least two guard drains are positioned adjacent to the sampling drain.

* * * * *